US005267881A

United States Patent [19]

Matuzaki

[11] Patent Number: 5,267,881

[45] Date of Patent: Dec. 7, 1993

[54] ELECTRICAL CONNECTOR

[75] Inventor: Shuichi Matuzaki, Tokyo, Japan

[73] Assignee: Hirose Electric Co., Ltd., Tokyo, Japan

[21] Appl. No.: 950,129

[22] Filed: Sep. 24, 1992

[51] Int. Cl.[5] ..... H01R 11/22

[52] U.S. Cl. ..... 439/660; 439/744

[58] Field of Search ..... 439/76, 660, 682, 733, 439/744, 745, 746, 868, 871, 873, 883

[56] References Cited

U.S. PATENT DOCUMENTS 4,610,497 9/1986 Tsuchida et al. ..... 439/660

5,085,601 2/1992 Buchter et al. ..... 439/660

*Primary Examiner*—Paula A. Bradley

*Attorney, Agent, or Firm*—Kanesaka & Takeuchi

[57] ABSTRACT

An electrical connector consists of a female connector and a male connector. The female connector includes a dielectric housing (1) having a plurality of contact element receiving slots (5) and a receptacle cavity (6) which communicates with the contact element receiving slots; and a plurality of female contact elements (2) mounted in the contact element receiving slots and having a U-shaped contact recess (11). The male connector includes a dielectric support (20) having a base section (21) and a plate member (22) extending forwardly from the base section so as to fit into the receptacle cavity and having a plurality of contact element receiving channels (22A); a plurality of male contact elements (24) supported by the dielectric support and having a contact portion (24A) fitted in the contact element receiving channel such that at least one surface thereof is exposed from the contact element receiving channel so that each male contact element is brought into contact with a corresponding female contact element when the plate member is inserted in the receptacle cavity.

2 Claims, 3 Drawing Sheets

ELECTRICAL CONNECTOR

BACKGROUND OF THE INVENTION

1. Field of the Invention

The present invention relates to electrical connectors which consist of a male connector having male contact elements with a U-shaped recess and a female connector having a configuration fitted into the U-shaped recess.

2. Description of the Related Invention

An electrical connector consists of a female connector having a plurality of female contact elements which are stamped and formed from sheet metal so as to have a U-shaped recess and a male connector having a plurality of pin-like male contact elements is well known in Japan. In the female contact elements, most of the outer surface of a contact portion of each female contact element is supported by the inner wall of a contact element receiving slot formed in the housing. In the male contact elements, however, the intermediate portion is supported by the housing, and the portion between the intermediate portion and the front end is cantilevered so as to project forwardly. In use, the male contact elements are inserted into the U-shaped recesses of the female contact elements for making electrical connections.

Since most of the outer surface of each female contact element is supported by the inner wall of the contact element receiving slot, no external forces make undesirable plastic deformation. However, the male contact elements cantilevered in the male connector project freely so that they can readily undergo plastic deformation by an external force. If the tip of a male contact element is deformed and offset, it strikes the tip of a female contact element subjecting it to plastic deformation. Also, the male contact element can be deformed by a forcible plugging operation. Even under a separate state, it can be deformed by an accidental force. When a male contact element is deformed, it is difficult or impossible to connect the male connector to the female connector. Even if the connection is done, it is unstable. In addition, since the male contact elements are supported by the intermediate portions only, it is necessary to provide long supporting portions to assure firm support. Consequently, the length of the housing and thus the connector is increased by that much.

SUMMARY OF THE INVENTION

Accordingly, it is an object of the invention to provide an electrical connector with a compact provision for protecting a plurality of male contact elements from plastic deformation.

According to the invention there is provided an electrical connector consists of a female connector and a male connector. The female connector includes a dielectric housing having a plurality of contact element receiving slots and a receptacle cavity which communicates with the contact element receiving slots; and a plurality of female contact elements mounted in the contact element receiving slots and having a U-shaped contact recess. The male connector includes a dielectric support having a base section and a plate member extending forwardly from the base section so as to fit into the receptacle cavity and having a plurality of contact element receiving channels; a plurality of male contact elements supported by the dielectric support and having a contact portion fitted in the contact element receiving channel such that at least one surface thereof is exposed from the contact element receiving channel so that each male contact element is brought into contact with a corresponding female contact element when the plate member is inserted in the receptacle cavity.

In use, the plate member of the male connector is inserted into the receptacle cavity of the female connector so that the male contact elements firmly supported by the plate member fit into the U-shaped recesses of the female contact elements, thus making electrical connection.

The above and other objects, features, and advantages of the invention will be more apparent from the following description when taken in conjunction with the accompanying drawings.

DESCRIPTION OF THE PREFERRED EMBODIMENT

The electrical connector according to an embodiment of the invention consists of a female connector having a plurality of female contact elements and a male connector having a plurality of male contact elements.

Figure 1:
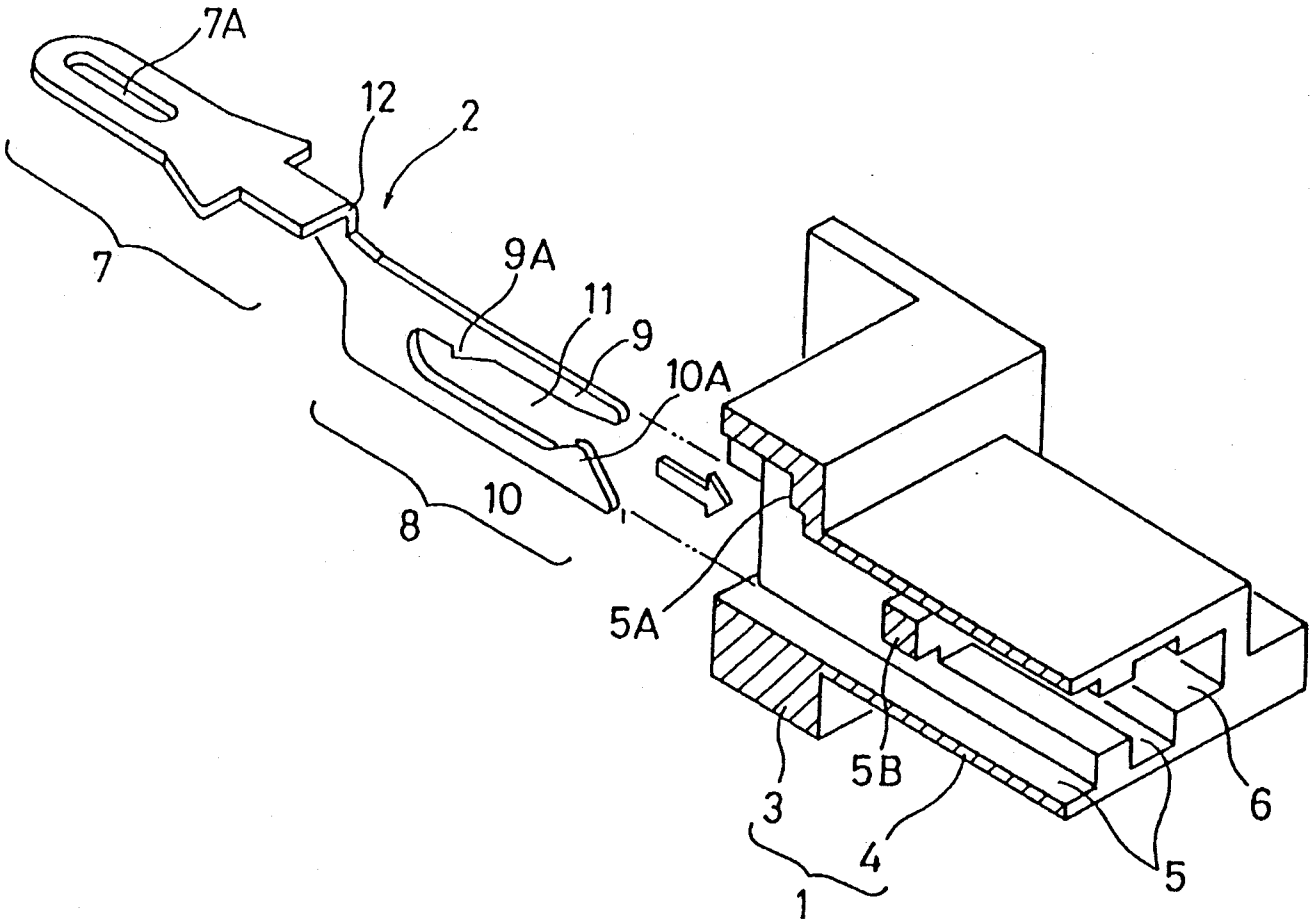
FIG. 1 is a partially cutaway perspective view of a female connector before assembling according to an embodiment of the invention.

In FIG. 1, a dielectric housing 1 of the female connector has a substantially solid base 3 and a substantially hollow section 4 extending forwardly from the solid base 3. A plurality of contact element receiving slots 5 are formed through the solid base 3 and the hollow section 4. A pair of guide sections 4A extend forwardly from the solid base 3 along the upper edge of the hollow section 4. A shoulder portion 5A is formed on the inside wall of each contact element receiving slot 5 in the solid base 3 for positioning the contact element. A projection member 5B is formed on the middle of the hollow section 4 for engaging the contact element. The contact element receiving slots 5 are communicated by a receptacle cavity 6 which extends forwardly from the projection members 5B.

The female contact elements 2 are stamped and formed from sheet metal so as to provide a connection section 7 and a contact section 8. The contact section 8 has a pair of finger members 9, 10 defining a substantially U-shaped recess 11. An engaging projection 9A and a contact projection 10A are formed on the inner edge of the upper finger 9 and the front end of the lower finger 10, respectively. The connection section 7 is made in a plane perpendicular to that of the contact section 8 and has an abutting face 12 at the front end. The connection section 7 has an elongated hole 7A to which the core wire of a cable is soldered.

Figure 2:
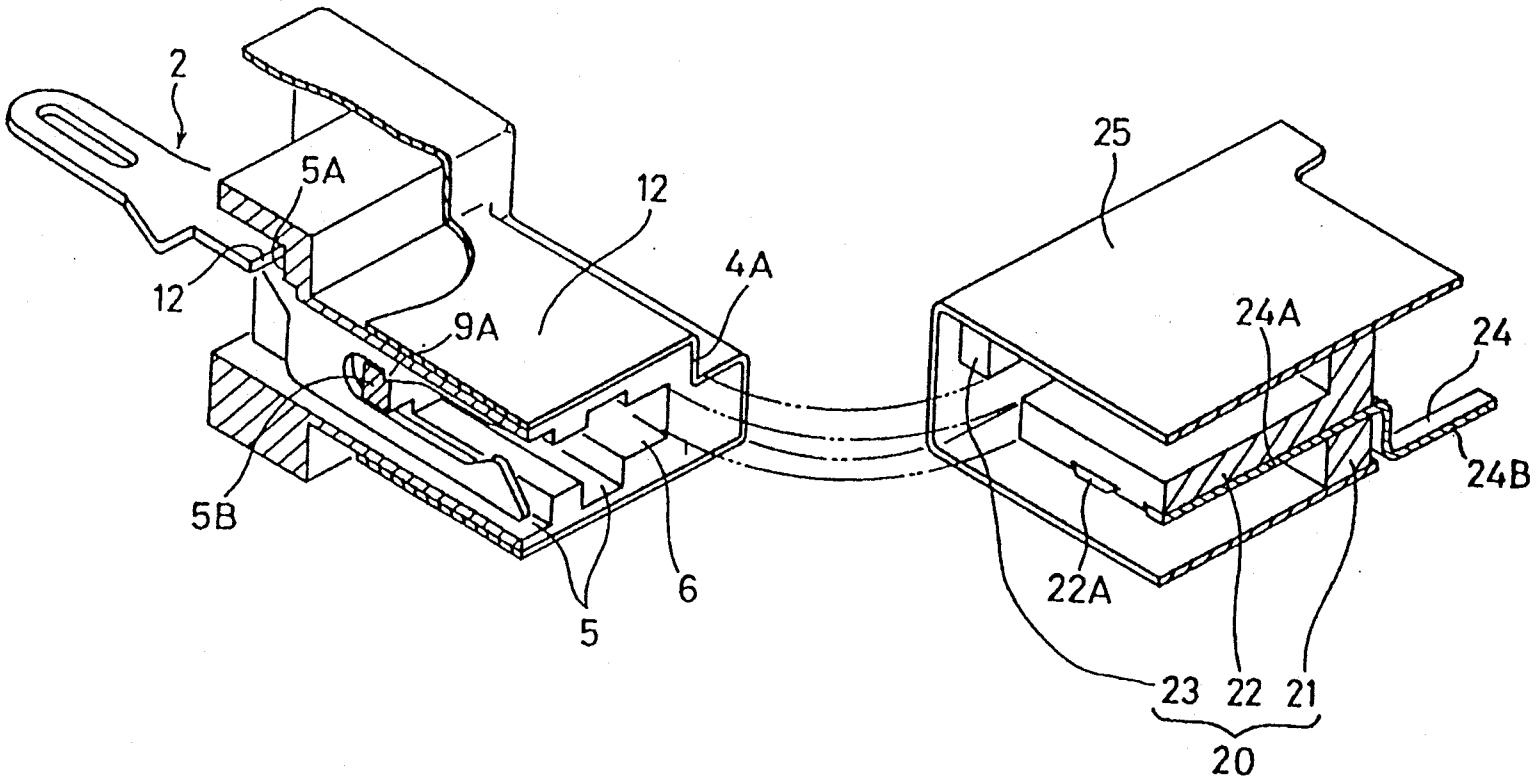
FIG. 2 is a partially cutaway perspective view of the assembled female and male connectors before connection.

In FIG. 2, the female contact elements 2 are inserted into the contact element receiving slots 5 from the back until the abutting face 12 abuts on the shoulder member 5A of the housing 1, where the engaging projection 9A of the female contact element 2 bites into the projection member 5B of the housing 1. Thus, the female contact elements 2 are positioned and prevented from being falling off, while most of the outer surfaces of the finger members 9, 10 are supported by the inner surfaces of the contact element receiving slot 5. Then, a metal case 42 is put over the dielectric housing 1 for shielding. If necessary, a dielectric cover is attached to the back of the solid base 3.

The male connector includes a dielectric support 20; a plurality of male contact elements 24 mounted in the dielectric support 20; and a shielding metal case 25 put over the dielectric support 20. The dielectric support 20 has a base section 21, a flat plate member 22 extending forwardly from the base section 21, and a pair of guiding bars 23 extending forwardly from the upper corners of the base section 21. The plate member 22 is made so as to fit into the receptacle cavity 6 of the female connector whereas the guiding bars 23 fit into the guide section 4A of the female connector.

A plurality of contact element receiving channels 22A extending rearwardly from the front end of the plate member 22 through the base section 21. Each contact element receiving channel 22A has a dovetail cross-section and is positioned to correspond to one of the female contact elements 2 when the plate member 22 is inserted in the receptacle cavity 6. The male contact element 24 is made in a substantially Z-shaped form and has a contact section 24A in the front portion and a connection section 24B in the rear portion. The male contact elements 24 have a trapezoidal cross-section fitted in the dovetail contact element receiving channel 22A. To assemble, the male contact elements 24 are inserted in the contact element receiving channels 22A from the back. The thickness of the contact sections 24A is made greater than the depth of the contact element receiving channels 22A so that their lower surfaces project from the contact element receiving channels 22A.

Figure 3:
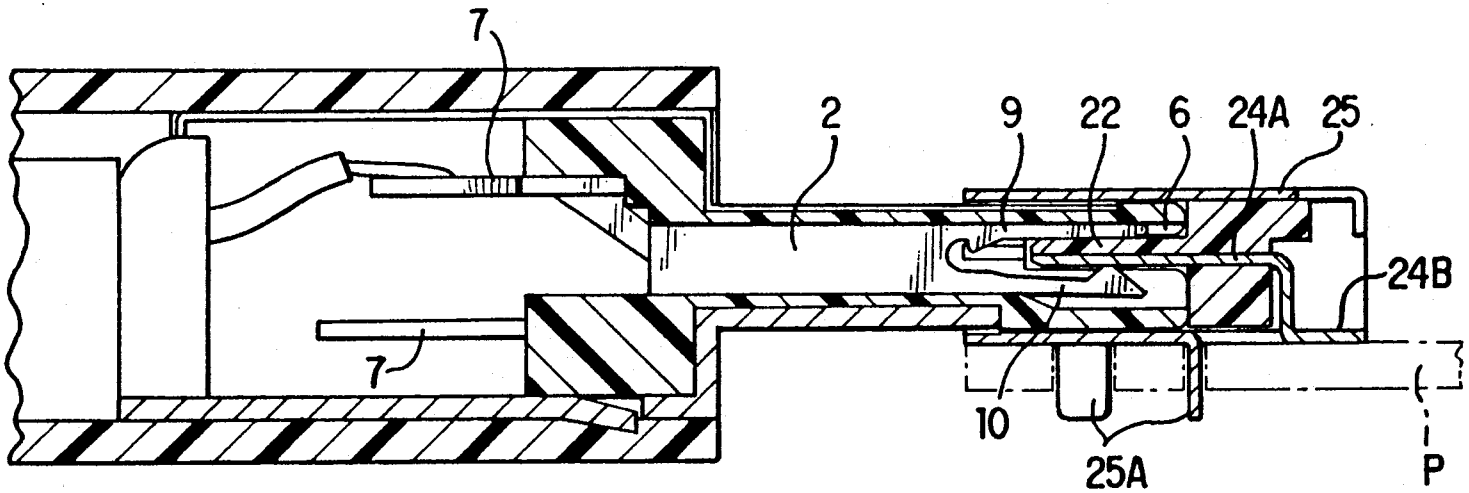
FIG. 3 is a cross section of the female and male connectors in connection.

In use, the plate member 22 of the male connector is inserted in the receptacle cavity 6 of the female connector while the front portion of the metal case 42 fits into the space defined by the metal case 25 and the guiding bars 23 of the male connector. When the plate member 22 is inserted in the receptacle cavity 6, the contact sections 24A of the male contact elements 24 are brought into spring contact with the contact projections 10A of the female contact elements 2 as shown in FIG. 3, subjecting the finger members 10 to elastic deformation, thereby opening the contact recesses 11. Thus, the male and female connectors are connected electrically. The male metal case 25 has depending legs 25A which are inserted into the engaging apertures of a board P and soldered to the circuit conductors of the board P.

As has been described above, the male contact elements are supported by the plate member of the dielectric support so that the support of the male contact element is very strong. Thus, upon connection with the female contact elements, few or no male contact elements are deformed, thereby eliminating the poor or unstable connection caused by the deformation of a contact element. Since the support is so strong that a short support portion of the dielectric support is satisfactory, thereby making the connector compact.

I claim:

1. An electrical connector consisting of a female connector and a male connector, said female connector comprising:

a dielectric housing having a plurality of contact element receiving slots and a receptacle cavity which communicates with said contact element receiving slots; and a plurality of female contact elements mounted in said contact element receiving slots and each having a pair of upper and lower fingers forming a U-shaped contact recess therebetween, said upper finger engages said dielectric housing so that it is fixed thereto;

said lower finger is cantilevered so as to have a spring property;

said male connector comprising:

a dielectric support having a base section and a plate member extending forwardly from said base section so as to fit into said receptacle cavity and having a plurality of contact element receiving channels;

a plurality of male contact elements supported by the dielectric support and having a contact portion fitted in said contact element receiving channel such that at least one surface thereof is exposed from said contact element receiving channel so that each male contact element is brought into contact with a corresponding female contact element when said plate member is inserted in said receptacle cavity.

2. The electrical connector of claim 1, wherein said contact element receiving channels have a dovetail cross-section while said male contact elements have a trapezoidal cross-section fitted in said dovetail cross-section.

* * * * *